US008120569B2

(12) United States Patent
Jou et al.

(10) Patent No.: US 8,120,569 B2
(45) Date of Patent: Feb. 21, 2012

(54) APPARATUS AND METHOD FOR ADAPTIVELY ADJUSTING BACKLIGHT

(75) Inventors: Ming-jong Jou, Hsin-Chu (TW); Yao-jen Hsieh, Hsin-Chu (TW); Huan-hsin Li, Hsin-Chu (TW)

(73) Assignee: AU Optronics Corp., Hsin-Shu (TW)

( * ) Notice: Subject to any disclaimer, the term of this patent is extended or adjusted under 35 U.S.C. 154(b) by 1259 days.

(21) Appl. No.: 11/775,506

(22) Filed: Jul. 10, 2007

(65) Prior Publication Data

US 2008/0068328 A1 Mar. 20, 2008

(30) Foreign Application Priority Data

Sep. 15, 2006 (TW) ..... 95134371 A

(51) Int. Cl.
*G09G 3/36* (2006.01)

(52) U.S. Cl. ..... 345/102; 362/97.2

(58) Field of Classification Search ..... 345/87–104; 362/97.1–97.4

See application file for complete search history.

(56) References Cited

U.S. PATENT DOCUMENTS

| | | | | |
|---|---|---|---|---|
| 6,839,048 | B2 | 1/2005 | Park | |
| 2002/0057252 | A1 | 5/2002 | Onodera | |
| 2002/0122020 | A1 | 9/2002 | Moon et al. | |
| 2004/0008177 | A1 | 1/2004 | Ahn | |
| 2004/0257318 | A1 | 12/2004 | Itoh | |
| 2005/0104837 | A1 * | 5/2005 | Baik et al. | 345/99 |
| 2005/0174320 | A1 | 8/2005 | Park | |
| 2005/0184952 | A1 * | 8/2005 | Konno et al. | 345/102 |
| 2005/0195152 | A1 | 9/2005 | Yang et al. | |
| 2005/0219199 | A1 | 10/2005 | Huang et al. | |
| 2005/0231458 | A1 | 10/2005 | Miki | |
| 2005/0242756 | A1 * | 11/2005 | Honbo | 315/403 |
| 2008/0094346 | A1 | 4/2008 | De Greef | |

FOREIGN PATENT DOCUMENTS

| | | |
|---|---|---|
| TW | 00527497 | 4/2003 |
| TW | 00535126 | 6/2003 |
| TW | 200528832 | 9/2005 |
| TW | 200530685 | 9/2005 |
| WO | 2005109391 | 11/2005 |
| WO | WO 2005109391 A1 * | 11/2005 |

* cited by examiner

*Primary Examiner* — Amr Awad
*Assistant Examiner* — Michael Pervan

(57) ABSTRACT

An apparatus and method for adaptively adjusting backlight are described. The backlight adjusting apparatus includes an intensity-pair distribution device, a brightness compensation module, a frame-adjusting device, a backlight control device, and a backlight module. The intensity-pair distribution device generates a plurality of intensity-pair distribution values of the image frames each composed of a plurality of pixel data. The brightness compensation module computes a dark-state ratio of the pixel data of a current image frame in response to the intensity-pair distribution values, and computes a brightness index of the current image frame in response to the dark-state ratio for generating a brightness compensating signal based on the dark-state ratio and the brightness index. The frame adjusting device adjusts the brightness of the total pixel data of the current image frame in response to brightness compensating signal. The backlight control device updates the brightness index of the current image frame in response to the brightness index of a previous image frame and the intensity-pair distribution values of the current image frame for generating a backlight control signal of the current image frame. The backlight module adjusts the backlight of the module in response to the backlight control signal.

18 Claims, 11 Drawing Sheets

APPARATUS AND METHOD FOR ADAPTIVELY ADJUSTING BACKLIGHT

FIELD OF THE INVENTION

The present invention generally relates to an adjusting system and a method thereof, and more particularly to an apparatus and method for adaptively adjusting backlight luminance.

BACKGROUND OF THE INVENTION

Generally, an liquid crystal display (LCD) mainly includes a transmissive type LCD, a reflective type LCD, and a semi-transmissive/semi-reflective type LCD. The transmissive type LCD has a backlight module, and the light source of the backlight module may be cold cathode fluorescent lamps (CCFLs), hot cathode fluorescent lamp (HCFLs), light emitting diodes (LEDs), or electro luminescent (EL) devices. Currently, the CCFL is widely used in most LCDs.

The light leakage of LCDs easily occurs in a dark-state having a low gray level. Further, because the LCD panel size is rapidly growing and the LCD panel is widely used in television sets, it is necessary to increase the viewing angle of LCD panels. However, the problem of light leakage associated with viewing angles should be strictly controlled. In addition, the backlight luminance is required to be adjusted dynamically because the dynamic contrast ratio of the LCD panel has to be increased to improve the display quality. However, conventionally, the above-mentioned problem is generally ignored when adjusting the luminance of the backlight because only the light in the environment is taken into account presently. Therefore, when employing a conventionally adjusting method, glimmer occurs easily in LCD panels. The luminance of LCD panels is not uniform, thereby degrading the display quality of LCD.

Consequently, there is a need to develop an adjusting system to improve the display quality of LCDs.

SUMMARY OF THE INVENTION

One object of the present invention is to provide a backlight adjusting system and method thereof for adaptively adjusting the intensity of image frame by a brightness compensating signal and adjusting the light intensity of the backlight module via the backlight control signal so that the image frame can uniformly be displayed on the LCD, and the power consumption of LCD is saved to decrease the operation temperature in order to extend the life span of the LCD.

Another object of the present invention is to provide a backlight adjusting system and method thereof for increasing the contrast ratio of the image frame by computing the dark-state ratio of the pixel data in the image frame to improve display quality of the LCD.

According to the above objects, the present invention sets forth an adjusting system and method thereof. The backlight adjusting system suitable for LCD display mainly includes an intensity-pair distribution device, a brightness compensation module electrically coupled to the intensity-pair distribution device, a frame-adjusting device electrically coupled to the brightness compensation module, a backlight control device electrically coupled to the intensity-pair distribution device and the brightness compensation module, and a backlight module electrically coupled to the backlight control device.

The intensity-pair distribution device receives a plurality of image frames to correspondingly generate a plurality of intensity-pair distribution values for each image frame, where each image frame is composed of a plurality of pixel data. The brightness compensation module computes a dark-state ratio of the pixel data of a current image frame in response to the intensity-pair distribution values of the current image frame, and computes a brightness index of the current image frame in response to the dark-state ratio for generating a brightness compensating signal based on the dark-state ratio and the brightness index of the current image frame. The frame adjusting device is used to adjust the brightness of the total pixel data of the current image frame in response to brightness compensating signals. In one embodiment, the data associated with the brightness compensating signals are stored into the brightness compensation storage unit and the brightness compensating data represent the brightness compensating profile.

The backlight control device is capable of updating the brightness index of the current image frame in response to the brightness index of a previous image frame and the intensity-pair distribution values of the current image frame for generating a backlight control signal of the current image frame. The backlight module adjusts the backlight of the backlight module in response to the backlight control signal from the backlight control device for adaptively matching the intensity of the current image frame with the luminance profile of backlight module.

According to the above-mentioned description, the brightness compensation module of the backlight adjusting system processes the intensity-pair distribution of image frame with the brightness index of the previous luminance profile of the backlight module to generate the compensating signal for modifying the image frame. Thus, the backlight module is compensated by the compensating signal to improve the frame uniformity and increase contrast ratio during the backlight adjustment. Further, the backlight control device processes the intensity-pair distribution of image frame with the brightness index of the previous luminance profile of the backlight module to generate the backlight control signal. The backlight control signal is used to generate new brightness index of the current luminance profile. Therefore, two signals, including the compensating signal and backlight control signal, are utilized to adaptively adjust the image frame and the backlight projected on the display device for showing the image frame. Consequently, the images are uniformly displayed on the display device to improve the display quality and the power consumption is saved for decreasing operation temperature of the display device.

In operation, the method of adjusting the backlight according to one embodiment of the present invention comprises the following steps: the intensity-pair distribution device receives a plurality of image frames; a plurality of intensity-pair distribution values of each of the frames are generated by the intensity-pair distribution device, wherein each of the image frames has a plurality of pixel data; the brightness compensation module computes a dark-state ratio of the pixel data in a current image frame in response to the intensity-pair distribution values of the current image frame, and computes a brightness index of the current image frame in response to the dark-state ratio for generating a brightness compensating signal based on the dark-state ratio and the brightness index of the current image frame; the brightness of the pixel data of the current image frame in response to the brightness compensating signal is adjusted by the frame-adjusting device; the brightness index of the current image frame in response to the brightness index of a previous image frame and the intensity-pair distribution values of the current image frame is updated by the backlight control device for generating a backlight control signal of the current image frame; and finally, the backlight module adjusts the backlight in response to the backlight control signal from the backlight control device for adaptively matching the intensity of the current image frame with the luminance profile of the backlight module.

The present invention provides a backlight adjusting system and method thereof for adaptively adjusting the brightness of image frame by a brightness compensating signal and adjusting the light intensity of the backlight module via the backlight control signal. Furthermore, the present invention provides a backlight adjusting system and method thereof for increasing the contrast ratio of the image frame.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

The present invention provides a backlight adjusting system and method thereof for adaptively adjusting the brightness of image frame by a brightness compensating signal and adjusting the light intensity of the backlight module via the backlight control signal. Furthermore, the present invention provides a backlight adjusting system and method thereof for increasing the contrast ratio of the image frame by computing the dark-state ratio of the pixel data in the image frame.

Figure 1:
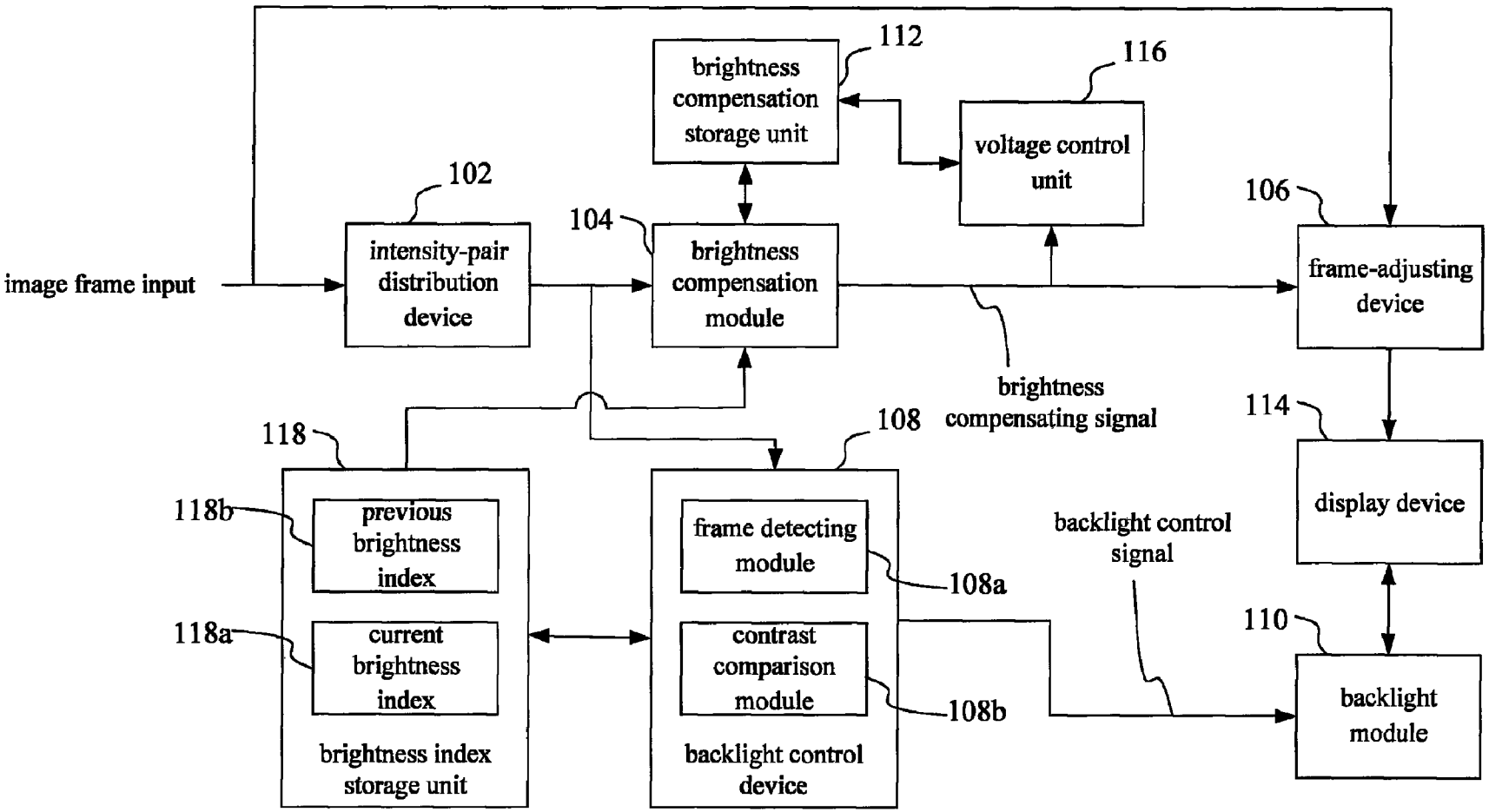
FIG. 1 is a schematic block diagram of a backlight adjusting system according to one embodiment of the present invention.

Please refer to FIG. 1 which depicts a schematic block diagram of a backlight adjusting system according to one embodiment of the present invention. The backlight adjusting system 100 suitable for LCD display mainly includes an intensity-pair distribution device 102, a brightness compensation module 104 electrically coupled to the intensity-pair distribution device 102, a frame-adjusting device 106 electrically coupled to the brightness compensation module 104, a backlight control device 108 electrically coupled to the intensity-pair distribution device 102 and the brightness compensation module 102, and a backlight module 110 electrically coupled to the backlight control device 108.

The intensity-pair distribution device 102 receives a plurality of image frames to correspondingly generate a plurality of intensity-pair distribution values of the image frames each, where each of the image frames is composed of a plurality of pixel data. The brightness compensation module 104 computes a dark-state ratio of the pixel data of a current image frame in response to the intensity-pair distribution values of the current image frame, and computes a brightness index of the current image frame in response to the dark-state ratio for generating a brightness compensating signal based on the dark-state ratio and the brightness index of the current image frame. The frame adjusting device 106 is used to adjust the brightness of the total pixel data of the current image frame in response to brightness compensating signal. In one embodiment, the data associated with the brightness compensating signal are stored into the brightness compensation storage unit 112 and the brightness compensating data represents the brightness compensating profile.

The backlight control device 108 is capable of updating the brightness index of the current image frame in response to the brightness index of a previous image frame and the intensity-pair distribution values of the current image frame for generating a backlight control signal of the current image frame. The backlight module 110 adjusts the backlight of the backlight module in response to the backlight control signal from the backlight control device for adaptively matching the intensity of the current image frame with the luminance profile of backlight module.

According to the above-mentioned description, the brightness compensation module 104 of the backlight adjusting system 100 processes the intensity-pair distribution of image frame with the brightness index of the previous luminance profile of the backlight module 110 to generate the compensating signal for modifying the image frame. Thus, the backlight module 110 is compensated by the compensating signal to improve the frame uniformity and increase contrast ratio during the backlight adjustment. Further, the backlight control device 108 processes the intensity-pair distribution of image frame with the brightness index 118*b* of the previous luminance profile of the backlight module 110 to generate the backlight control signal. The backlight control signal is used to generate new brightness index 118*a* of the current luminance profile. Therefore, two signals, including the compensating signal and backlight control signal, are utilized to adaptively adjust the image frame and the backlight projected on the display device for showing the image frame. Consequently, the images are uniformly displayed on the display device 114 to improve the display quality and the power consumption 114 is saved for decreasing operation temperature of the display device.

Figure 2A:
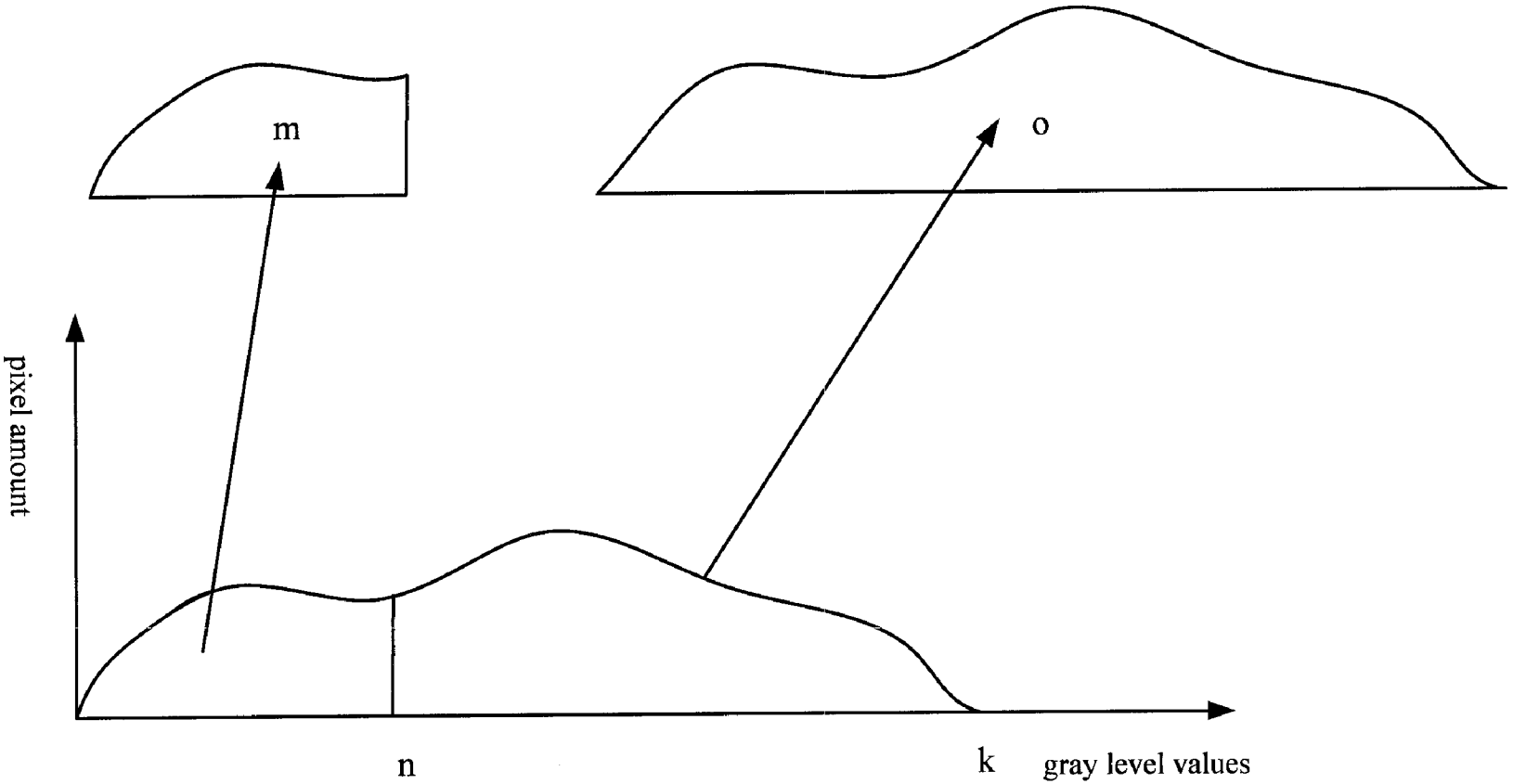
FIG. 2A is a schematic diagram of the intensity-pair distribution profile of image frame according to one embodiment of the present invention.

Please refer to FIG. 2A which depicts a schematic diagram of the intensity-pair distribution profile of image frame according to one embodiment of the present invention. The coordinates of horizontal axis of the profile represents gray level values. The coordinates of vertical axis of the profile represents the amount of the pixel data of image frame. The dark-state ratio (BR) of the brightness compensation module 104 is a ratio value between a partial pixel data "m" and total pixel data "o" of the image frame is multiplied by the gray level (termed as "k", e.g. 255 or arbitrary positive integer), where the gray level of the partial pixel data in the image frame is lower than a predetermined value.

Further, in the present invention, the brightness index of the current image frames is the sum of the largest gray level multiplying a first weighting value and the dark-state ratio multiplying a second weighting value for each image frames. That is, intensity-pair distribution values of the pixel data of image frame each are computed and the largest value of the pixel data having a gray level "k", are generated. Then, brightness index (BI) is defined as follows: BI=q*k+(1−q)*BR, where q is a first weighting value and adjustable value in the range from 0 to 1. It should be noted that the first weighting value can be arbitrary positive integer. The expression of (1−q) is defined as a second weighting value. The brightness index (BI) represents the ratio between dark-state and brightness-state of the pixel data in an image frame. The brightness index (BI) further serves as the parameter for modifying the image frame and the backlight.

Figure 2B:
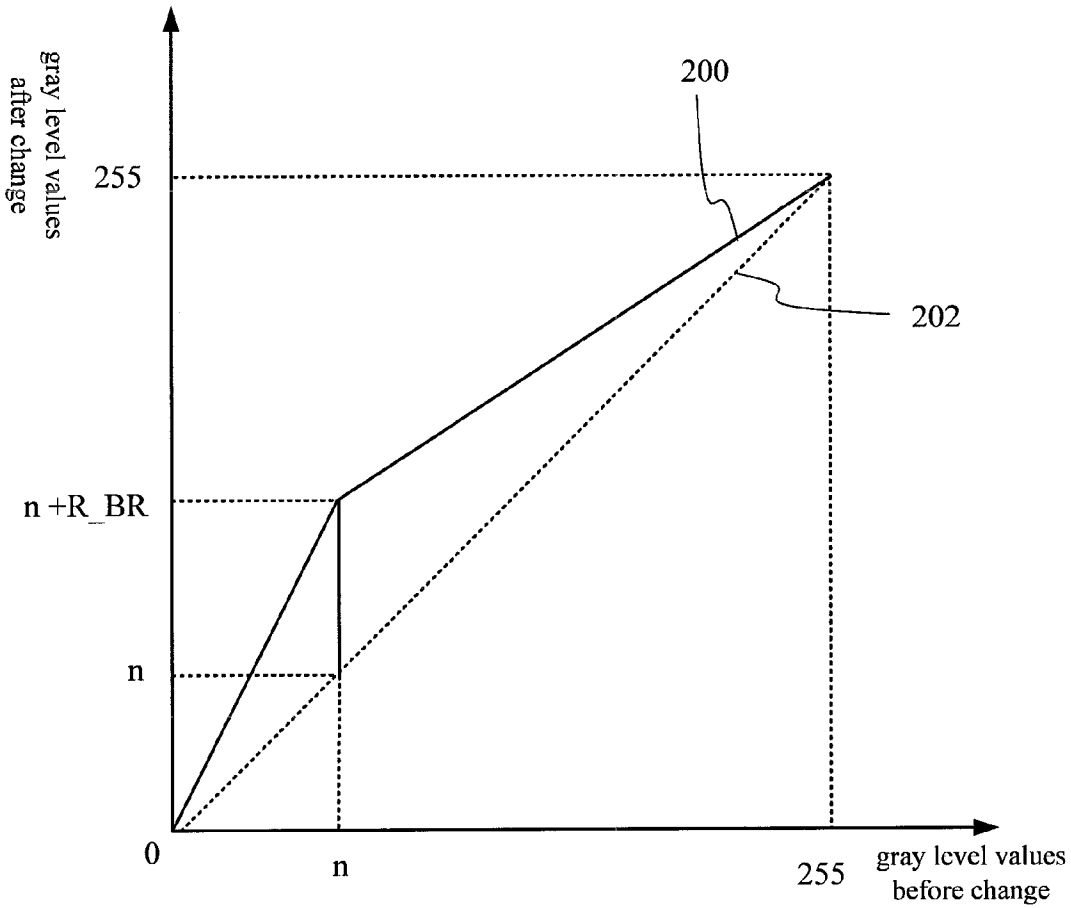
FIG. 2B is a schematic diagram of dark-state compensation profile according to one embodiment of the present invention.

Please refer to FIG. 2B which depicts a schematic diagram of dark-state compensation profile according to one embodiment of the present invention. In one embodiment, to compensate the variation of gray level due to the decrement of backlight brightness, the present invention modifies the brightness profile of image frame to adjust the pixel brightness. The horizontal axis of brightness profile 200 represents the gray level of the pixel data before the image frame is changed without modification. The vertical axis of brightness profile 202 represents the gray level of the pixel data after the image frame is changed with modification. The gray level in a change point termed as "R_BR" is equal to the multiplication of dark-state ratio (BR) and positive integer "R". That is, the gray level "n" in horizontal axis is changed to the gray level (n+R_BR) in vertical axis, and the change point is connected linearly to the points of gray level zero and 255, respectively. It should be noted that dashed line 202 is the original dark-state compensating profile before adjusting the backlight.

Figure 2C:
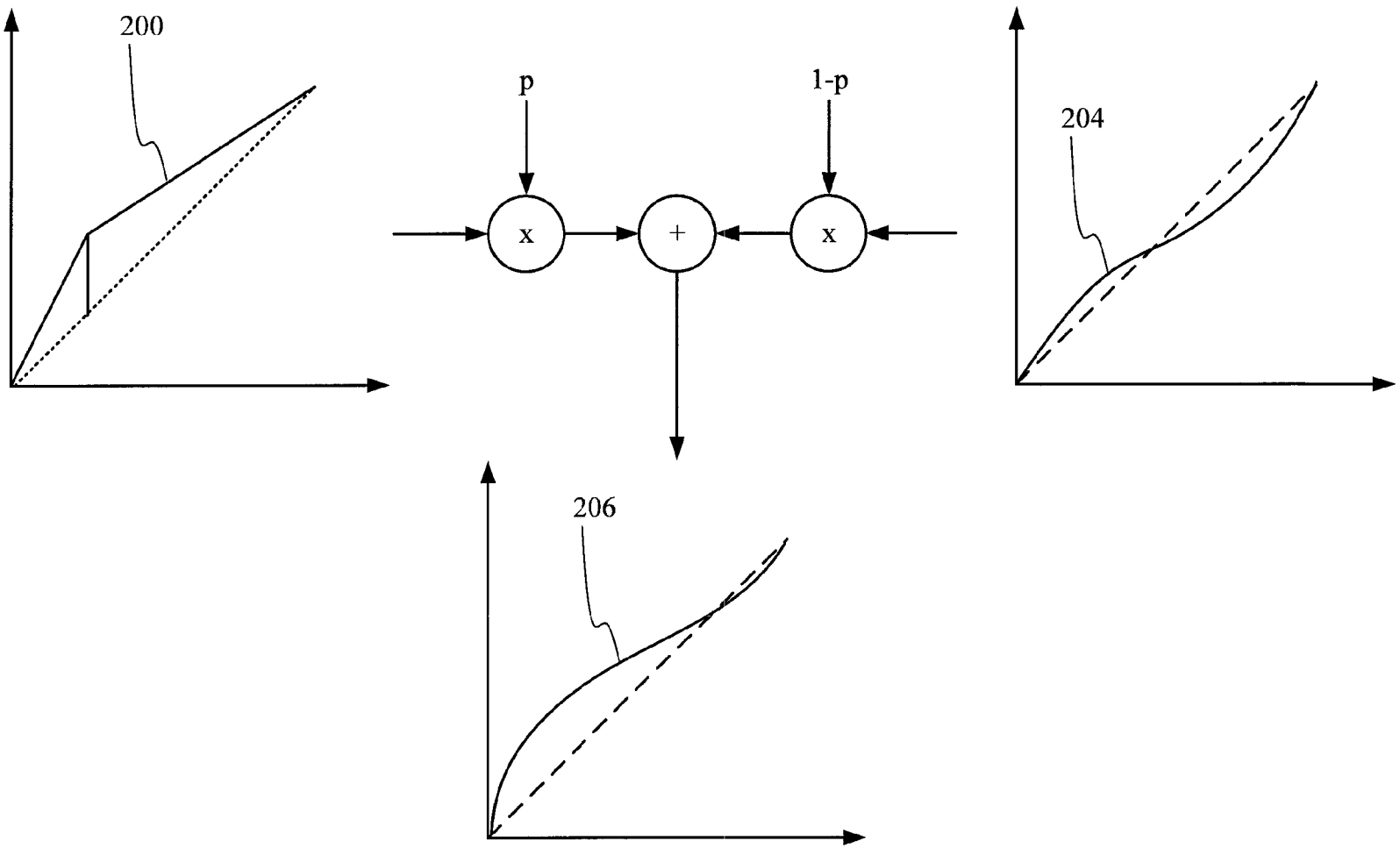
FIG. 2C is a schematic diagram of new dark-state compensation profile wherein the voltage control unit generates the new dark-state compensation profile by using the dark-state compensation profile shown in FIG. 2B according to one embodiment of the present invention.

Please refer to FIG. 1 and FIG. 2C which depicts a schematic diagram of new dark-state compensation profile wherein the voltage control unit generates the new dark-state compensation profile by using the dark-state compensation profile shown in FIG. 2B according to one embodiment of the present invention. In FIG. 1, the backlight adjusting system 100 includes a voltage control unit 116 electrically coupled to the brightness compensation module 104 and the voltage control unit 116 receives the brightness compensating signal. The brightness compensation module 104 multiplies the compensating signal by a first adjusting value, and multiplies the voltage signal by a second adjusting value for summing up the multiplied values to adjust the brightness compensating signal from the brightness compensation module 104 to generate a new dark-state compensation profile 206. The values of original voltage control profile multiplying expression (1−p) is added to the dark-state compensation profile 206 multiplying adjustable parameter "p", where "p" is in the range from 0 to 1, or arbitrary positive integer.

Figure 3:
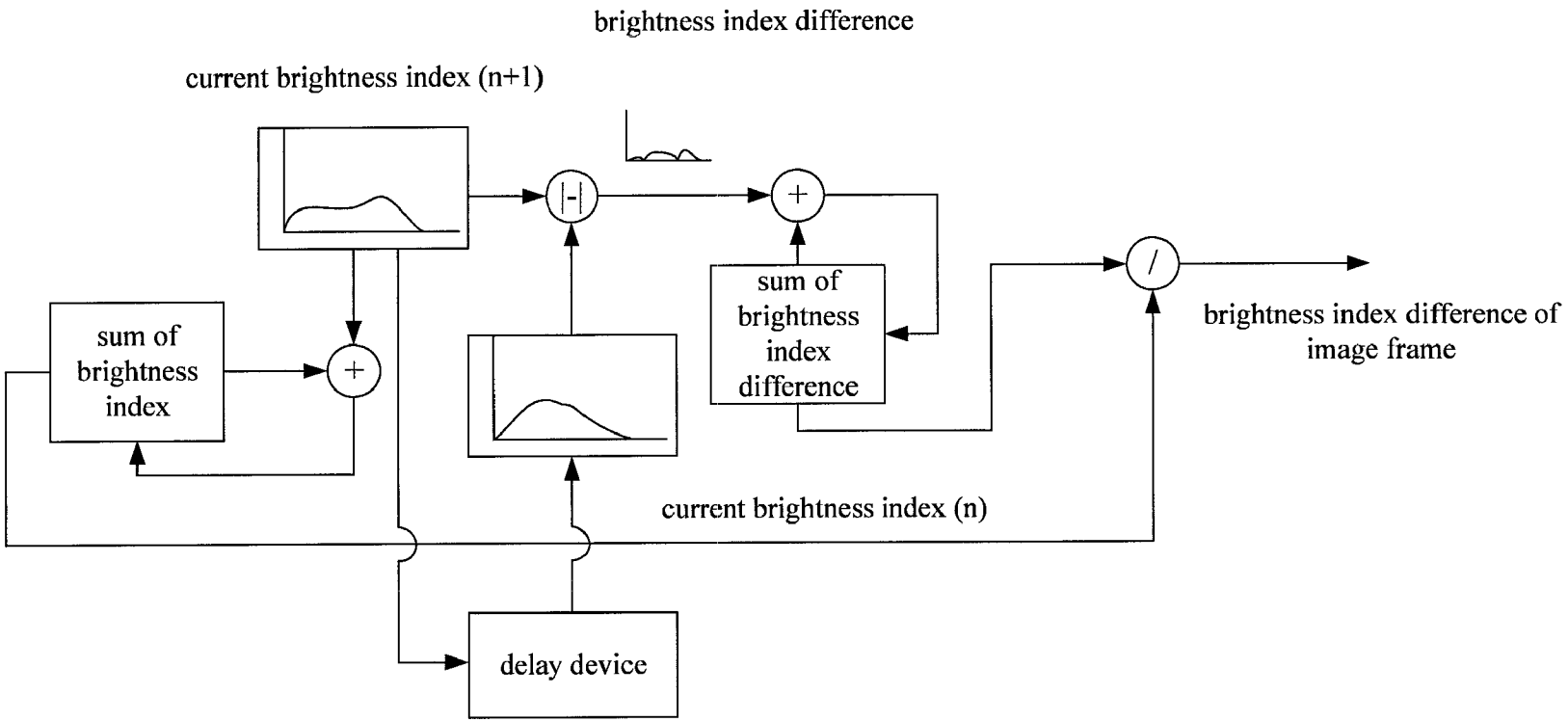
FIG. 3 is a detailed schematic block diagram of the frame detecting module of backlight controller shown in FIG. 1 according to one embodiment of the present invention.

Please refer to FIG. 1 and FIG. 3 which depicts a detailed schematic block diagram of the frame detecting module of backlight controller 108 shown in FIG. 1 according to one embodiment of the present invention. The frame detecting module 108*a* is electrically coupled to the intensity-pair distribution device 102. The frame detecting module 108*a* detects the image frame difference between the current image frame and the previous image frame by computing the intensity-pair distribution difference between the intensity-pair distribution values of the current image frame and the intensity-pair distribution values of the previous image frame. The frame detecting module 108*a* further divides the intensity-pair distribution difference by the intensity-pair distribution values of the previous image frame for determining whether the brightness index is adjusted to a target brightness index in response to the image frame difference. In one preferred embodiment of the present invention, the brightness index 118*a* in the current fame and the brightness index 118*b* in the previous fame are stored into the brightness index storage unit 118.

In detail, the detection mechanism of background brightness of image frame is determined by the intensity-pair distribution profile between the current image frame and the previous image frame. When the intensity-pair distribution profile of the previous image frame and current image frame is (n) and (n+1), respectively, and represented as follows:

$$H_n(0), H_n(1), \ldots, H_n(a); \text{and}$$

$$H_{n+1}(0), H_{n+1}(1), \ldots, H_{n+1}(a),$$

where "a" is an arbitrary positive integer, such as gray level "k".

$$D_S = \sum_{i=0}^{a} |H_n(i) - H_{n+1}(i)| \tag{1}$$

Formula (1) represents that "D_S" is the sum of the intensity-pair distribution differences between the current image frame and the previous image frame.

$$S = \sum_{i=0}^{a} H_n(i) \tag{2}$$

Formula (2) represents that "S" is the total sum of the intensity-pair distributions.

According to the above-mentioned description, the frame difference "hist_diff_ratio" is represented as expression (D_S/S). When the brightness index of the previous image frame is different from the target brightness index, the frame detection module adjusts the brightness index of the current image frame to the target brightness index in response to the frame difference. For example, when the scene of the image frame is changed fast and thus obvious glimmer is accompanied with the scene of the image frame. Therefore, the brightness index can be directly adjusted to the desired brightness. On the contrary, when the scene of the image frame is changed smoothly, the brightness index is gradually adjusted to avoid obvious glimmer of the scene of the image frame.

Continuously refer to FIG. 1. The backlight adjusting system 100 further includes a contrast comparison module 108*b* electrically coupled to the intensity-pair distribution device 102. The contrast comparison module 108*b* compares the contrast between the current image frame and the previous image frame by computing the contrast ratio of the current image frame and the previous image frame in response to the intensity-pair distribution values for adjusting the backlight luminance based on the comparison result.

Since the user is sensitive to the contrast of the image frame but senses the brightness change of the image frame with difficulty, the brightness should be retained without change to avoid frame glimmer due to brightness change when the contrast of the image frame is invariant. Particularly, the contrast (CR) of the image frame is defined as the subtraction result of the highest brightness and lowest brightness in one image frame, i.e. the expression of CR=max(Y)−min(Y). When the contrast difference between the contrast (CR_n) of current image frame (n) and the contrast (CR_n+1) of previous image frame (n+1) is smaller than threshold value (CR_th), it means that the contrast between the current image frame (n) and previous image frame (n+1) is approximately the same and thus the backlight luminance is not adjusted. Conversely, when the contrast difference between the contrast (CR_n) of current image frame (n) and the contrast (CR_n+1) of previous image frame (n+1) is smaller than threshold value (CR_th), it is necessary to adjust the backlight luminance.

In one embodiment, when the brightness index of the previous image frame is different from the target brightness index, the frame detection module adjusts the brightness index of the current image frame to the target brightness index in response to the image frame difference. A change interval corresponding to the image frame difference is defined as "BR_INC" and includes: (a) frame difference ratio; (b) brightness difference ratio; and (c) predetermined difference ratio. They will be depicted in detail below.

(a) Frame Difference Ratio

The frame difference is defined as the difference "hist_diff_ratio" between the current image frame and the previous image frame. When the frame difference is "K" and change margin at a time is predetermined ratio "c", the change interval is equal to the expression of "c*K". For example, when the current brightness index is termed as "BR_curr" and the target brightness index is termed as "BR_dest", the next brightness index is equal to the expression "BR_curr+(c*K)" so that the expression result is approximately equal to "BR_dest".

For example, the brightness index "BR_curr" of current image frame is 100, the target brightness index is 127, frame difference is 20, the predetermined ratio "c" is 0.5, and the brightness change process is listed as follows:

The brightness index in first change is: 100+20*0.5=110;

The brightness index in second change is: 110+20*0.5=120; and

The brightness index in third change is: 120+20*0.5=130, where the brightness index 130 in third change is greater than the target brightness index 127 and, hence, the target brightness index 127 is selected to be the output of brightness index.

When the current brightness index is greater than the target brightness index, the current brightness index should be decreased. For example, the current brightness index is 100, the target brightness index is 87, the frame difference is 20, the predetermined ratio "c" is 0.5, and the change process is listed as follows:

The brightness index in first change is: 100−20*0.5=90; and

The brightness index in second change is: 90−20*0.5=80, where the brightness index 80 in second change is smaller than the target brightness index 87 and, hence, the target brightness index 87 serves as the output of brightness index.

(b) Brightness Difference Ratio

Figure 4A:
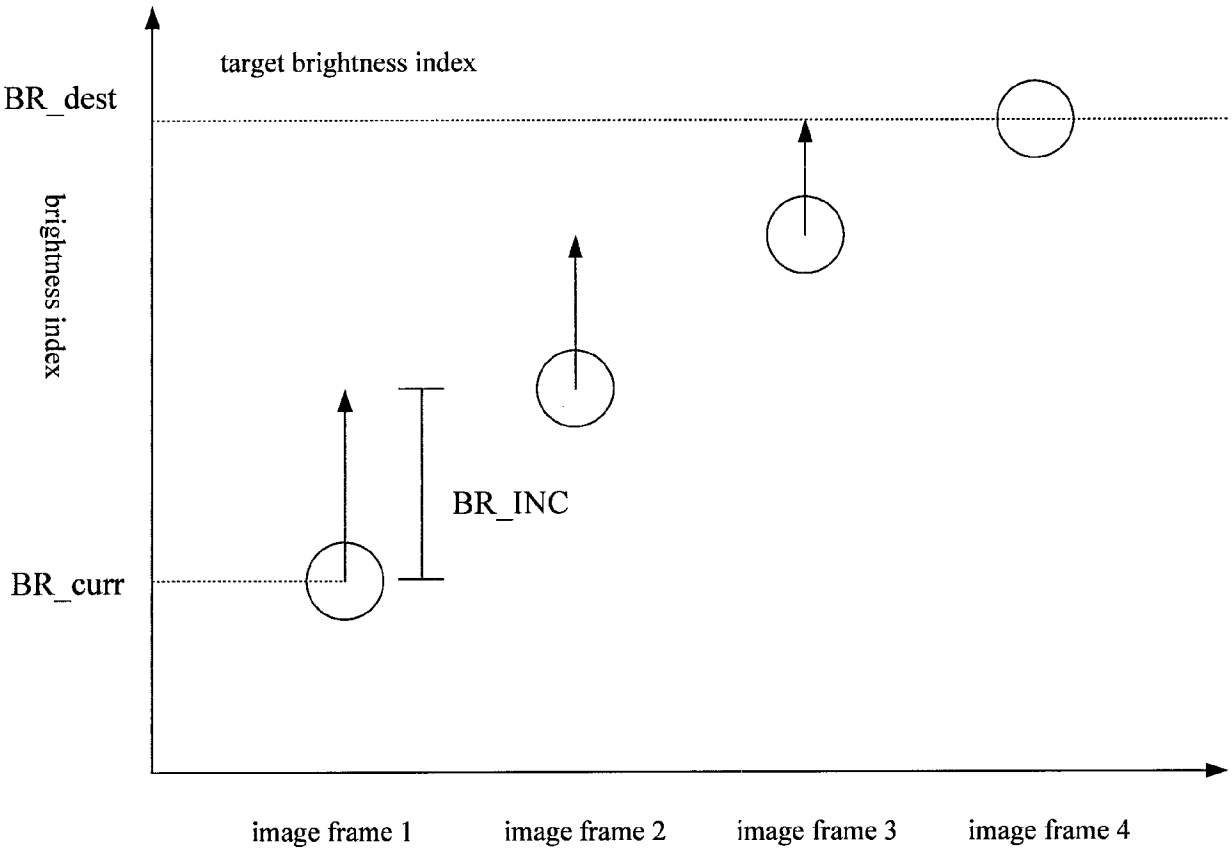
FIG. 4A is a schematic diagram of brightness index wherein the frame detection module adjusts the brightness index of the current image frame to the target brightness index in response to the brightness difference ratio between current brightness index and target brightness index according to one embodiment of the present invention.

As shown in FIG. 4A, it is a schematic diagram of brightness index wherein the frame detection module adjusts the brightness index of the current image frame to the target brightness index in response to the brightness difference ratio between current brightness index and target brightness index according to one embodiment of the present invention. When the brightness index of the previous image frame is different from the target brightness index, the frame detection module adjusts the brightness index of the current image frame to the target brightness index in response to the ratio of the brightness difference.

When the difference between the current brightness and the target brightness index is more and more large, the frame difference should be increased and the frame difference is represented as the multiplication of the expression of (BR_dest−BR_curr) and predetermined ratio "c". For example, the brightness index "BR_curr" of current image frame is 100, the target brightness index is 150, the predetermined ratio "c" is 0.5, and the change process is listed as follows:

The brightness index in first change is: 100+0.5*(150−100)=125;

The brightness index in second change is: 125+0.5*(150−125)=138; and

The brightness index in third change is: 138+0.5*(150−138)=144, where the result of brightness index 144 in third change is the brightness output.

(c) Predetermined Difference Ratio

Figure 4B:
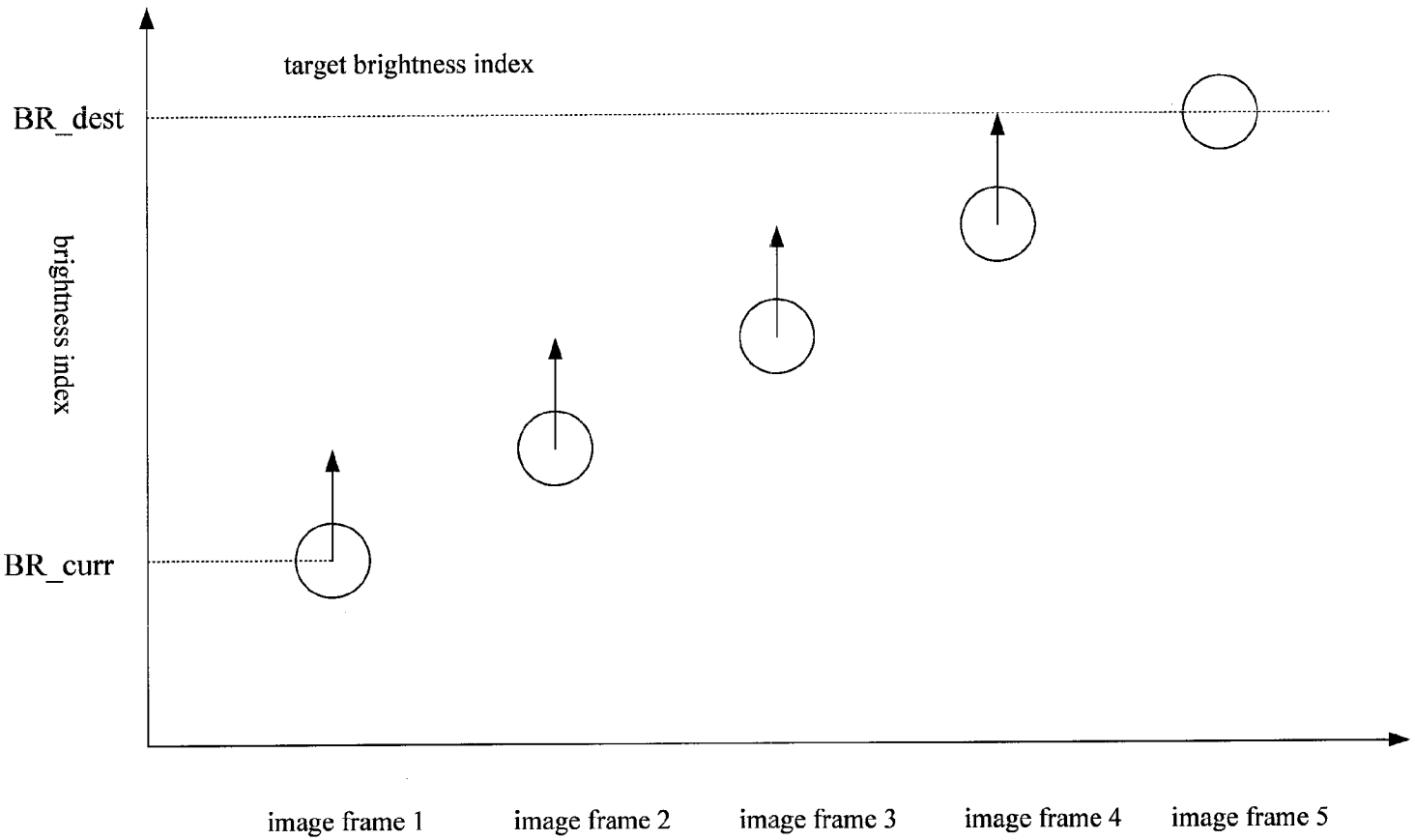
FIG. 4B is a schematic diagram of brightness index wherein the frame detection index at a predetermined difference ratio to the target brightness index according to one embodiment of the present invention.

As shown in FIG. 4B, it is a schematic diagram of brightness index wherein the frame detection module adjusts the brightness index of the current image frame to the target brightness index at a predetermined difference ratio to the target brightness index according to one embodiment of the present invention. When the brightness index of the previous image frame is different from the target brightness index, the frame detection module adjusts the brightness index of the current image frame a predetermined difference ratio to the target brightness index.

In a variety of frame difference, the brightness index reaches to the target brightness index by a predetermined difference ratio. For example, the current brightness index is 100, the target brightness index is 117, the predetermined ratio "c" is 0.5, and the change process is listed as follows:

The brightness index in first change is: 100+10=110; and

The brightness index in second change is: 110+10=120, where the brightness index 120 in second change is greater than the target brightness index 117 and, hence, the target brightness index 117 serves as the output of brightness index.

Figure 5:
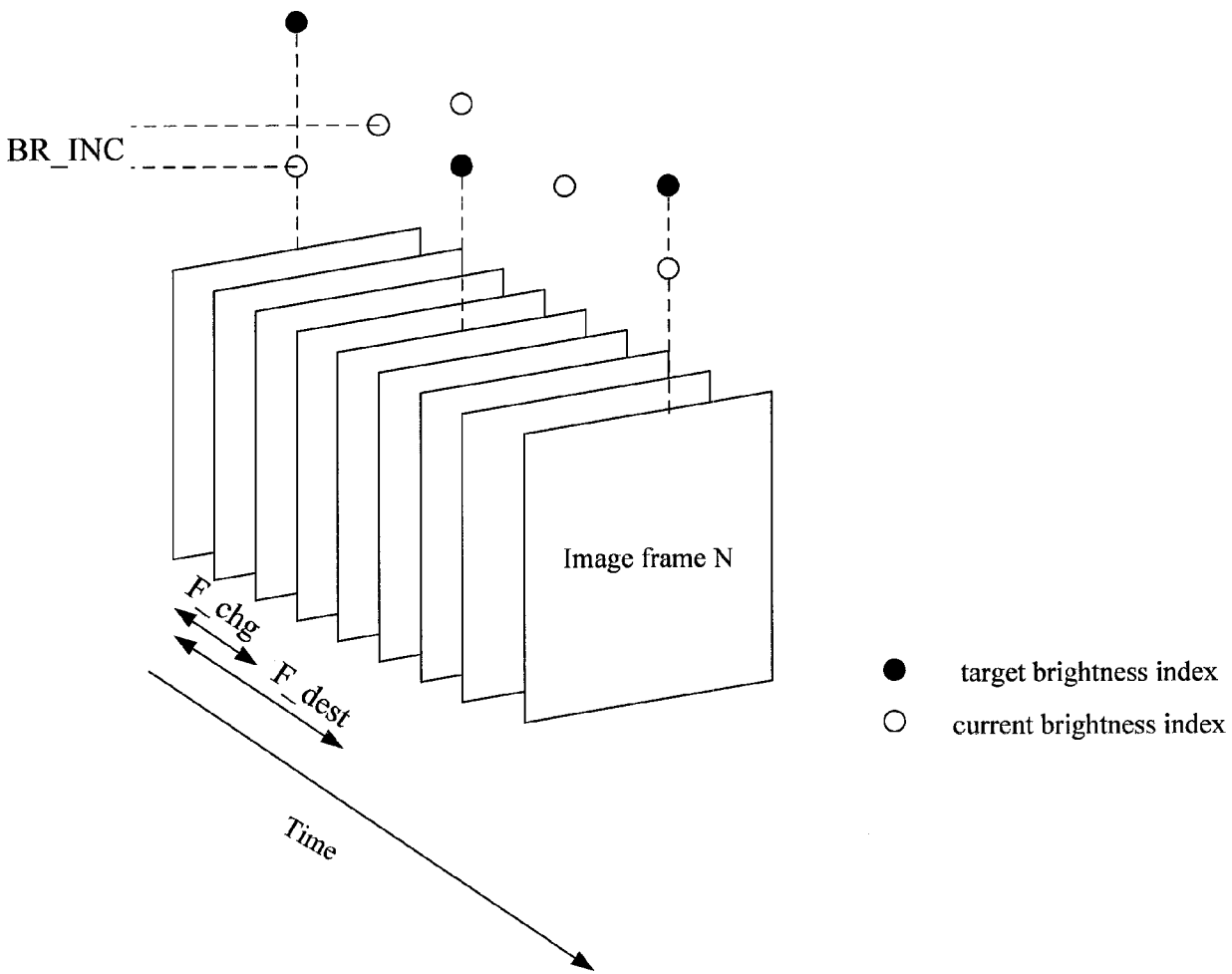
FIG. 5 is a schematic diagram wherein the frame for generating the target brightness index is different from the frame for determining the brightness index of the current image frame according to one embodiment of the present invention.

Please refer to FIG. 5 which depicts a schematic diagram wherein the frame for generating the target brightness index is different from the frame for determining the brightness index of the current image frame according to one embodiment of the present invention. The frame for generating the target brightness index is different from the frame for determining the brightness index of the current image frame. When target brightness change function "F_dest" and current brightness change function "F_curr" are generated, the final brightness index is determined by the interval of the target brightness change function "F_dest". The current brightness index is changed to new brightness index after "F_chg" is performed, where "F_chg" represents the change of brightness index in view of time. In other words, when the scene of image frame is considerably changed, the current brightness index can be directly changed to the target brightness index. Conversely, when the scene of image frame is changed smoothly, the current brightness index can be gradually changed to the target brightness index.

Figure 6A:
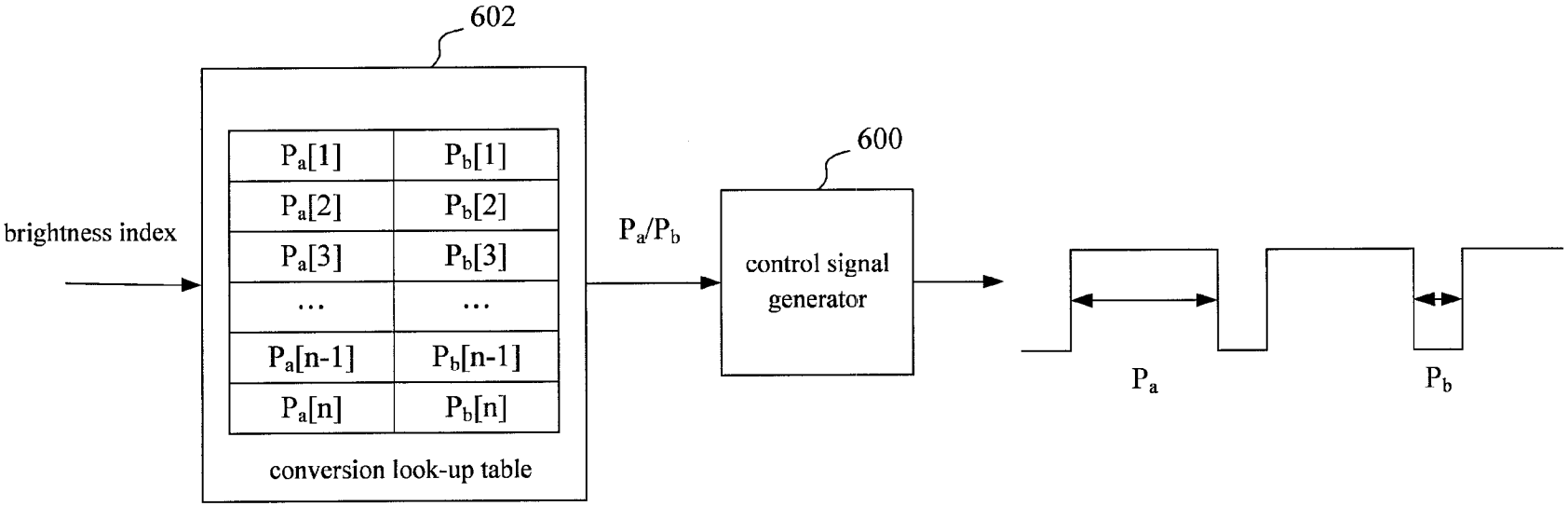
FIG. 6A is a schematic diagram of conversion look-up table and the waveform output frequency of the brightness index according to one embodiment of the present invention.

Please refer to FIG. 6A which depicts a schematic diagram of conversion look-up table and the waveform output frequency of the brightness index according to one embodiment of the present invention. The backlight adjusting system includes a conversion look-up table 602. The conversion look-up table is inquired in response to the computed brightness index to generate a high level and a low level in a pulse width modulation signal for adjusting the luminance of the backlight module. In detail, the conversion look-up table 602 is inquired by the brightness index to find two parameters, Pa and Pb. Then, the control signal generator 600 outputs the pulse width modulation signal on basis of the two parameters. Pa is the time duration of high level and Pb is the time duration of low level, or vice versa. The backlight module 110 in FIG. 1 can adjust the brightness of the light source in response to Pa and Pb. In one embodiment, the control signal generator 600 is the circuit composed of counter, comparator or the combination thereof.

Figure 6B:
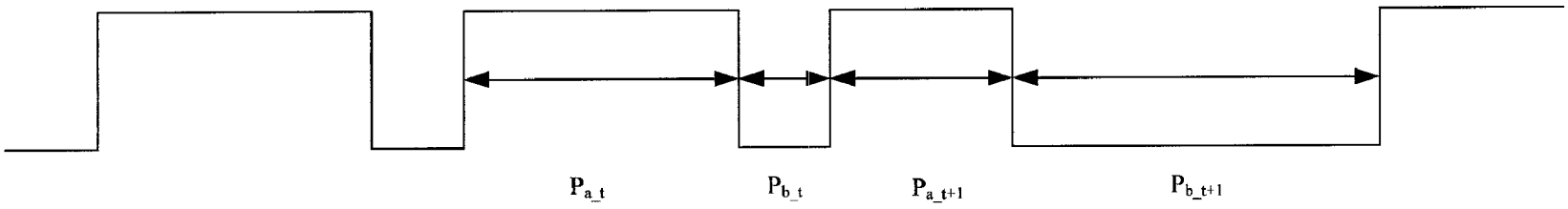
FIG. 6B is a schematic diagram of the waveform output frequency for adjusting the pulse width modulation signal to adjust the intensity of the backlight module according to one embodiment of the present invention.

In another embodiment, the brightness index is time-variant and the expression of (Pa/Pb) is time-variant. Therefore, the waveform output frequency of the brightness index is changeable for adjusting the backlight dynamically. As shown in FIG. 6B, it is a schematic diagram of the waveform output frequency for adjusting the pulse width modulation signal to adjust the intensity of the backlight module according to one embodiment of the present invention.

Figure 7:
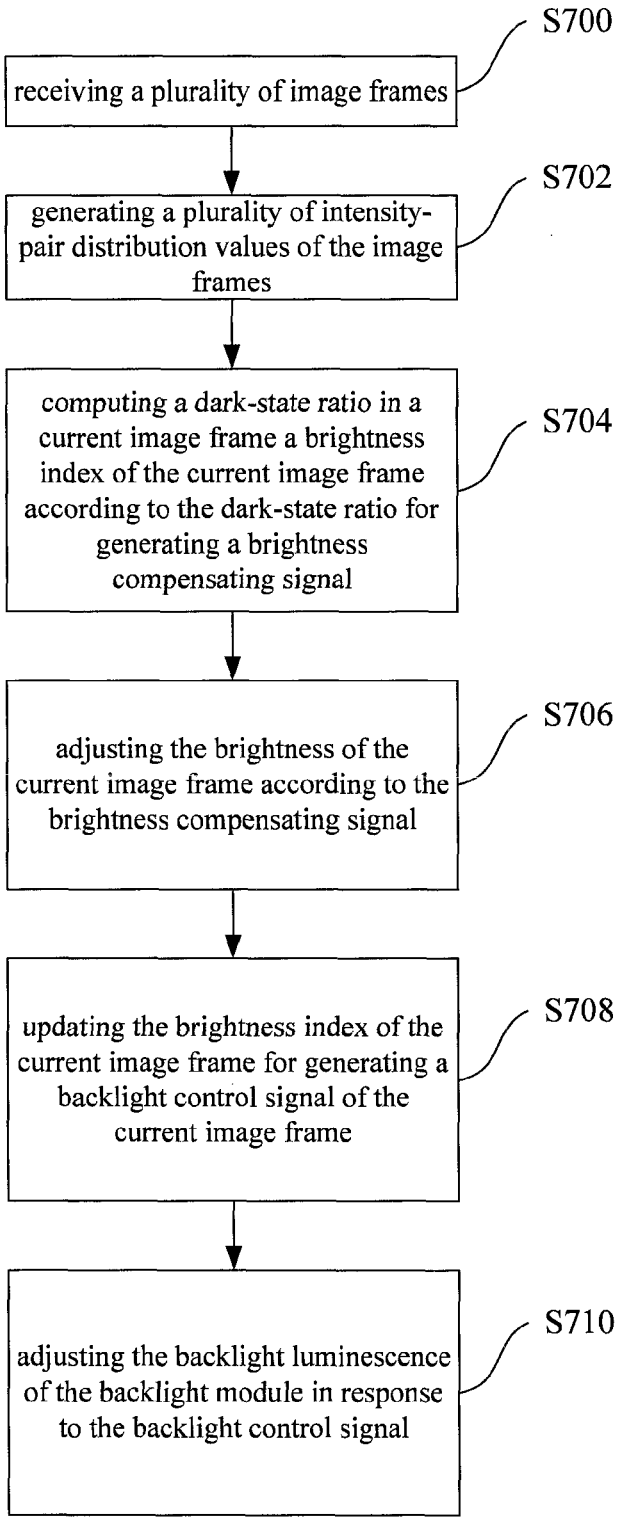
FIG. 7 is a flow chart of adjusting the backlight according to one embodiment of the present invention.

Please refer to FIG. 1 and FIG. 7 which depicts a flow chart of adjusting the backlight according to one embodiment of the present invention.

In step S700, the intensity-pair distribution device 102 receives a plurality of image frames.

In step S702, a plurality of intensity-pair distribution values of each of the frames are generated by the intensity-pair distribution device 102, wherein each of the image frames has a plurality of pixel data.

In step S704, the brightness compensation module 104 computes a dark-state ratio of the pixel data in a current image frame in response to the intensity-pair distribution values of the current image frame, and computes a brightness index of the current image frame in response to the dark-state ratio for generating a brightness compensating signal based on the dark-state ratio and the brightness index of the current image frame.

In step S706, the brightness of the pixel data of the current image frame in response to the brightness compensating signal is adjusted by the frame-adjusting device 106.

In step S708, the brightness index of the current image frame in response to the brightness index of a previous image frame and the intensity-pair distribution values of the current image frame is updated by the backlight control device 108 for generating a backlight control signal of the current image frame.

Finally, in step S710, the backlight module 110 adjusts the backlight in response to the backlight control signal from the backlight control device 108 for adaptively matching the intensity of the current image frame with the luminance profile of the backlight module 110.

The present invention provides a backlight adjusting system and method thereof for adaptively adjusting the brightness of image frame by a brightness compensating signal and adjusting the light intensity of the backlight module via the backlight control signal so that the image frame can uniformly be displayed on the LCD and the power consumption of LCD is saved to decrease the operation temperature to extend the life span of LCD. Furthermore, the present invention provides a backlight adjusting system and method thereof for increasing the contrast ratio of the image frame by computing the dark-state ratio of the pixel data in the image frame to improve display quality of LCD.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structures.

What is claimed is:

1. An apparatus of adaptively adjusting backlight for use in a liquid crystal display, the apparatus comprising:

an intensity-pair distribution device for receiving a plurality of image frames to correspondingly generate a plurality of intensity-pair distribution values of the image frames, wherein each of the image frames is composed of a plurality of pixel data;

a brightness compensation module, electrically coupled to the intensity-pair distribution device, for computing a dark-state ratio of the pixel data in a current image frame in response to the intensity-pair distribution values of the current image frame, and for computing a brightness index of the current image frame in response to the dark-state ratio for generating a brightness compensating signal based on the dark-state ratio and the brightness index of the current image frame, wherein the dark-state ratio of the brightness compensation module is the ratio between the amount of the gray pixel data in one image frame and the total amount of the pixel data in the image frame, and the gray levels of the gray pixel data are lower than a predetermined value, and wherein the brightness index of the current image frames is the sum of the largest gray level multiplying a first weighting value and the dark-state ratio multiplying a second weighting value for each image frame;

a frame-adjusting device, electrically coupled to the brightness compensation module, for adjusting the brightness of the pixel data of the current image frame in response to the brightness compensating signal;

a backlight control device, electrically coupled to the intensity-pair distribution device and the brightness compensation module, for updating the brightness index of the current image frame in response to the brightness index of a previous image frame and the intensity-pair distribution values of the current image frame for generating a backlight control signal of the current image frame; and a backlight module, electrically coupled to the backlight control device, for adjusting the backlight luminance of the backlight module in response to the backlight control signal from the backlight control device for adaptively matching the brightness of the current image frame with the luminance profile of the backlight module.

2. The apparatus according to claim 1, further comprising a voltage control unit, electrically coupled to the brightness compensation module, for receiving the brightness compensating signal, wherein the brightness compensation module multiplies the compensating signal by a first adjusting value, and multiplies the voltage signal by a second adjusting value for summing up the multiplied values to adjust the brightness compensating signal from the brightness compensation module.

3. The apparatus according to claim 1, further comprising a frame detection module, electrically coupled to the intensity-pair distribution device, for detecting an image frame difference between the current image frame and the previous image frame by computing the intensity-pair distribution difference between the intensity-pair distribution values of the current image frame and the intensity-pair distribution values of the previous image frame, and for dividing the intensity-pair distribution difference by the intensity-pair distribution value of the previous image frame so as to determine whether the brightness index of the current image frame is adjusted to a target brightness index according to the image frame difference.

4. The apparatus according to claim 3, wherein when the brightness index of the previous image frame is different from the target brightness index, the frame detection module is configured to adjust the brightness index of the current image frame to the target brightness index in response to the ratio of the image frame difference.

5. The apparatus according to claim 3, wherein when the brightness index of the previous image frame is different from the target brightness index, the frame detection module is configured to adjust the brightness index of the current image frame to the target brightness index in response to the ratio of the brightness difference.

6. The apparatus according to claim 3, wherein when the brightness index of the previous image frame is different from the target brightness index, the frame detection module is configured to adjust the brightness index of the current image frame at a predetermined difference ratio to the target brightness index.

7. The apparatus according to claim 1, further comprising a contrast comparison module, electrically coupled to the intensity-pair distribution device, for comparing the contrast between the current image frame and the previous image frame by computing the contrast ratio of the current image frame and the previous image frame in response to the intensity-pair distribution values for adjusting the backlight luminance based on the comparison result.

8. The apparatus according to claim 1, wherein the image frame for generating the target brightness index is different from the image frame for determining the brightness index of the current image frame.

9. The apparatus according to claim 1, further comprising a conversion look-up table for inquiring the conversion look-up table in response to the brightness index to generate a pulse width modulation signal for adjusting the luminance of the backlight module.

10. A method of adaptively adjusting a backlight for use in a liquid crystal display, the method comprising:

receiving a plurality of image frames;

generating a plurality of intensity-pair distribution values of the image frames each, wherein each of the image frames is composed of a plurality of pixel data;

computing a dark-state ratio of the pixel data in a current image frame in response to the intensity-pair distribution values of the current image frame, and computing a brightness index of the current image frame according to the dark-state ratio for generating a brightness compensating signal based on the dark-state ratio and the brightness index of the current image frame, wherein the dark-state ratio of the brightness compensation module is the ratio between the amount of the gray pixel data in one image frame and the total amount of the pixel data in the image frame, and the gray levels of the gray pixel data are lower than a predetermined value, and wherein the brightness index of the current image frames is the sum of the largest gray level multiplying a first weighting value and the dark-state ratio multiplying a second weighting value for each image frame;

adjusting the brightness of the pixel data of the current image frame according to the brightness compensating signal;

updating the brightness index of the current image frame according to the brightness index of a previous image frame and the intensity-pair distribution values of the current image frame for generating a backlight control signal of the current image frame; and adjusting the backlight luminance of the backlight module in response to the backlight control signal from the backlight control device for adaptively matching the brightness of the current image frame with the luminance profile of the backlight module.

11. The method according to claim 10, further comprising multiplying the compensating signal by a first adjusting value, and multiplying the voltage signal by a second adjusting value for summing up the multiplied values to adjust the brightness compensating signal from the brightness compensation module.

12. The method according to claim 10, further comprising detecting an image frame difference between the current image frame and the previous image frame by computing the intensity-pair distribution difference between the intensity-pair distribution value of the current image frame and the intensity-pair distribution value of the previous image frame, and dividing the intensity-pair distribution difference by the intensity-pair distribution value of the previous image frame for determining whether the brightness index of the current image frame is adjusted to a target brightness index according to the image frame difference.

13. The method according to claim 12, wherein when the brightness index of the previous image frame is different from the target brightness index, the frame detection module adjusts the brightness index of the current image frame to the target brightness index according to the image frame difference.

14. The method according to claim 12, wherein when the brightness index of the previous image frame is different from the target brightness index, the frame detection module is configured to adjust the brightness index of the current image frame to the target brightness index according to the intensity-pair distribution difference.

15. The method according to claim 12, wherein when the brightness index of the previous image frame is different from the target brightness index, the frame detection module is configured to adjust the brightness index of the current image frame at a predetermined interval to the target brightness index.

16. The method according to claim 10, further comprising comparing the contrast difference between the current image frame and the previous image frame by computing the contrast ratio of the current image frame and the previous image frame according to the intensity-pair distribution values for adjusting the backlight luminance based on the comparison result.

17. The method according to claim 10, wherein the image frame for generating the target brightness index is different from the image frame for determining the brightness index of the current image frame.

18. The method according to claim 10, further comprising inquiring the conversion look-up table according to the brightness index to generate a high level and a low level in a pulse width modulation signal for adjusting the luminance of the backlight module.

* * * * *